US007026761B2

(12) United States Patent
Saleem et al.

(10) Patent No.: US 7,026,761 B2
(45) Date of Patent: Apr. 11, 2006

(54) MAGNETRONS

(75) Inventors: Kesar Saleem, Ilford (GB); Michael B Brady, Maldon (GB)

(73) Assignee: E2V Technologies (UK) Limited, Chelmsford (GB)

( * ) Notice: Subject to any disclaimer, the term of this patent is extended or adjusted under 35 U.S.C. 154(b) by 0 days.

(21) Appl. No.: 10/240,222

(22) PCT Filed: Mar. 30, 2001

(86) PCT No.: PCT/GB01/01473

§ 371 (c)(1),
(2), (4) Date: Apr. 2, 2003

(87) PCT Pub. No.: WO01/75928

PCT Pub. Date: Oct. 11, 2001

(65) Prior Publication Data

US 2003/0150722 A1 Aug. 14, 2003

(30) Foreign Application Priority Data

Mar. 30, 2000 (GB) ..... 0007783.4

(51) Int. Cl.
*H01J 25/50* (2006.01)

(52) U.S. Cl. ..... 315/39.51; 315/39.61

(58) Field of Classification Search ..... 315/39, 315/39.3, 39.51, 39.53, 39.63, 3; 313/304; 330/47, 42
See application file for complete search history.

(56) References Cited

U.S. PATENT DOCUMENTS

| | | | | |
|---|---|---|---|---|
| 3,315,121 | A * | 4/1967 | Staats | 315/39.51 |
| 3,458,753 | A | 7/1969 | Staats | 315/39.3 |
| 4,143,300 | A * | 3/1979 | Cutting et al. | 315/39.61 |
| 5,210,465 | A * | 5/1993 | Squibb | 315/39.53 |
| 5,280,218 | A * | 1/1994 | Smith | 315/39.3 |

FOREIGN PATENT DOCUMENTS

| | | |
|---|---|---|
| GB | 458631 | 12/1936 |

* cited by examiner

*Primary Examiner*—Tuyet Vo
*Assistant Examiner*—Jimmy Vu
(74) *Attorney, Agent, or Firm*—Kirschstein, et al.

(57) ABSTRACT

A magnetron includes a decoupling plate located between the end hat of the magnetron cathode and an output coupling member. The use of the decoupling plate presents a high impedance and gives a resonant circuit which is arranged to be resonant at the operating frequency of the magnetron. This prevents or reduces power loss due to capacitive coupling. In another arrangement, the decoupling plate is mounted to a post on the end hat of the magnetron cathode.

8 Claims, 2 Drawing Sheets

MAGNETRONS

This application is a national stage application filed under 35 USC § 371 of PCT Application PCT/GB01/01473 filed Mar. 30, 2001, which claims the benefit of foreign priority Application No. 00077834 filed Mar. 30, 2000 .

This invention relates to magnetrons and more particularly to magnetrons in which output energy is coupled axially from the device.

A magnetron in which output energy is coupled along the longitudinal axis of the device is illustrated schematically in FIG. 1. A cathode 1 is located on a longitudinal axis X—X and surrounded by an anode structure 2. The anode includes a cylindrical anode shell 3 from the interior of which a plurality of anode vanes, two of which 4 and 5 are shown, project to define resonant cavities between them. Magnetic pole pieces 6 and 7 located at the ends of the coaxial structure are arranged to produce an axial magnetic field in the region between the cathode 1 and the anode 2.

In this magnetron, energy is extracted from the magnetron via a coaxial output line 8 having an outer conductor 9 and an inner conductor 10. The inner conductor 10 is joined to a metallic output coupling member 11 which includes a disc part 12 and a plurality of conductive fingers 13, 14 around its periphery which connect with alternate anode vanes. During operation of the magnetron, energy is coupled via the output coupling member 11 to the output 8.

The inventors have realised that a problem may arise with the magnetron of the type illustrated in FIG. 1, particularly where it is to be operated to give a high output energy. Capacitive coupling exists between the output coupling member 11 and the end 15 of the cathode 1 which faces it, this part of the cathode often being termed a "top hat". The capacitive coupling is illustrated as $C_o$ in FIG. 1. The problem is particularly acute where a large number of anode cavities are included, for example, in magnetrons which are operated at X band. The existence of the capacitive coupling leads to a loss in output energy.

According to the invention, there is provided a magnetron comprising: a cathode coaxially surrounded by an anode; an axial output having an output coupling member connected to the anode; and a decoupling plate located between the end of the cathode and the said member.

By employing the invention, power loss due to capacitive coupling is reduced or prevented. The decoupling plate is a high impedance component which in one preferred embodiment of the invention comprises a disc mounted on a post, with the post being mounted on the output coupling member. The disc forms a slot with the facing surface of the output coupling member to present a high impedance in series with the already existing capacitance $C_o$. Advantageously, the dimensions of the decoupling plate are selected such that the equivalent circuit of the decoupling plate is an inductance and capacitance in parallel which gives a resonant circuit which is resonant at the operating frequency of the magnetron. This then prevents or reduces power loss due to capacitive coupling. Although it is preferred that the equivalent circuit of the decoupling plate acts as a resonant circuit which is resonant at the operating frequency of the magnetron, it may still prove of benefit where the resonant frequency is different to the operating frequency.

Another advantage of using the invention is that it enables the effects of the inherent capacitive coupling to be negated whilst still retaining the cathode end hat configuration, thus protecting surrounding metal surfaces from stray electrons from the anode/cathode region of the magnetron.

The decoupling plate is preferably a disc, providing a large surface area parallel to the end hat of the cathode and also to the facing surface of the output coupling member. Other plate configurations could be used however. The decoupling plate may be of any suitable material, such as copper, for example.

As mentioned above, in a preferred embodiment the decoupling plate is supported by a post which is mounted on the output coupling member. In another arrangement, the post is supported by the cathode. This arrangement still provides a high impedance component in series with the existing inherent capacitance at the output of the magnetron but it is less convenient to implement.

Some ways in which the invention may be performed are now described by way of example with reference to the accompanying drawings, in which.

Figure 1:
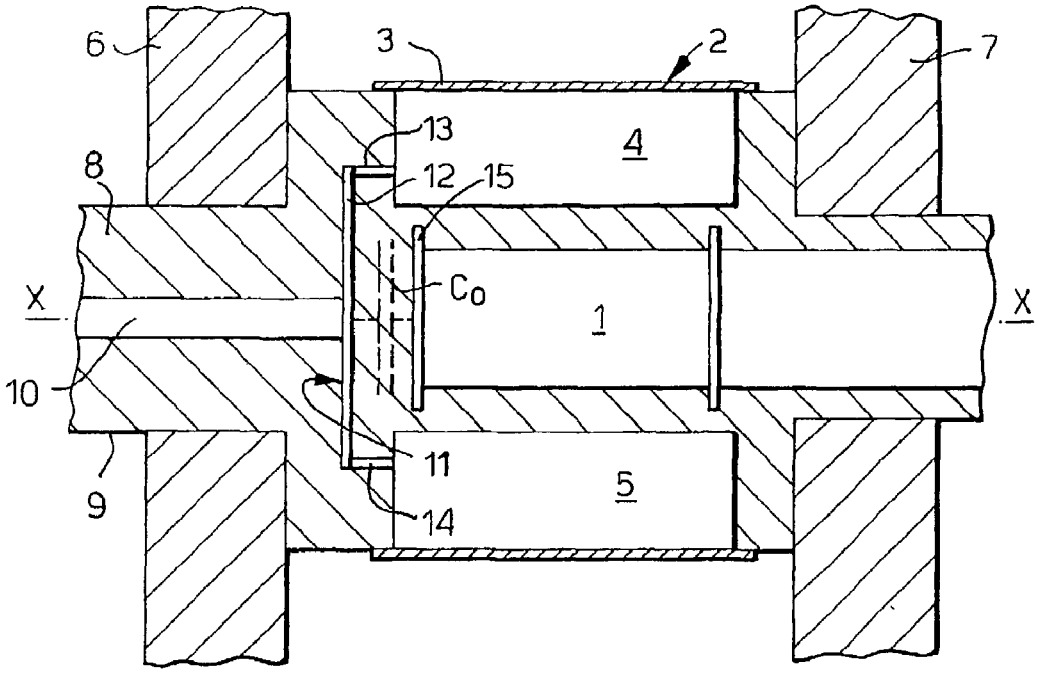
Figure 2:
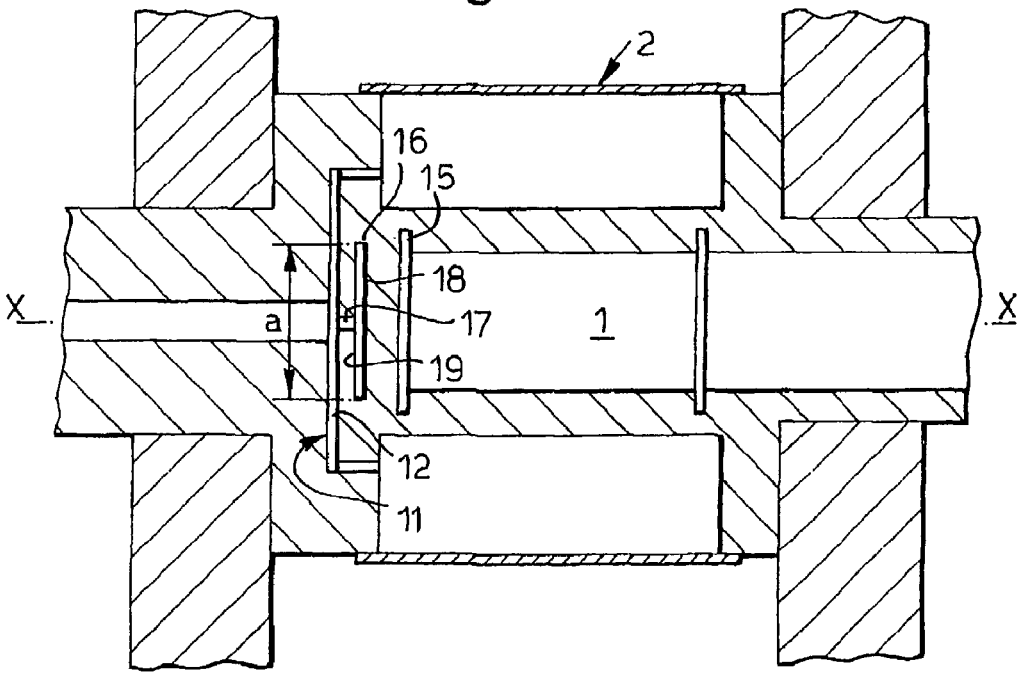
FIG. 2 is a schematic longitudinal view of a magnetron in accordance with the invention.

With reference to FIG. 2, a magnetron is similar to that described with reference to FIG. 1 and for convenience, the same reference numerals are used for the same components. A cathode 1 is surrounded by an anode 2 and a coaxial output line 9 is connected via an output coupling member 11 to extract energy from the interior of the magnetron.

In this magnetron, a copper decoupling plate 16 is located between the end hat 15 of the cathode and the disc 12 forming part of the output coupling member 11. The plate 16 is a circular planar member and is support at its centre by a post 17 which is mounted at the centre of the disc 12. A capacitance exists between the face 18 of the decoupling plate 16 which faces the end of the top hat 15, this capacitance $C_0$ being that which exists in the arrangement of FIG. 1. In addition, there is a capacitance which exists between the other face 19 of the decoupling plate 16 which faces the output coupling member 12.

Figure 3:
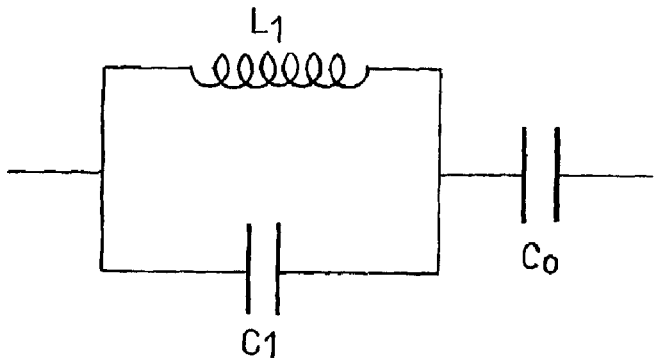
FIG. 3 is an explanatory diagram relating to the magnetron of FIG. 2.

The decoupling plate 16 forms a slot with the output coupling member 12 which is a quarter wavelength long, shown as dimension a in FIG. 2. The introduction of the decoupling plate 16 presents an effective inductance and capacitance in parallel which give a resonant circuit arranged to resonant at the operating frequency of the magnetron. The equivalent circuit is illustrated in FIG. 3 where $L_i$ and $C_1$ are the inductance and capacitance due to the decoupling plate 16 and the capacitance $C_o$ is the pre-existing capacitance.

The capacitive coupling is zero when the dimensions and location of the decoupling plate 16 are chosen such that $$f = \frac{1}{2\pi\sqrt{L_i C_i}}$$

where f is the operating frequency of the magnetron.

Figure 4:
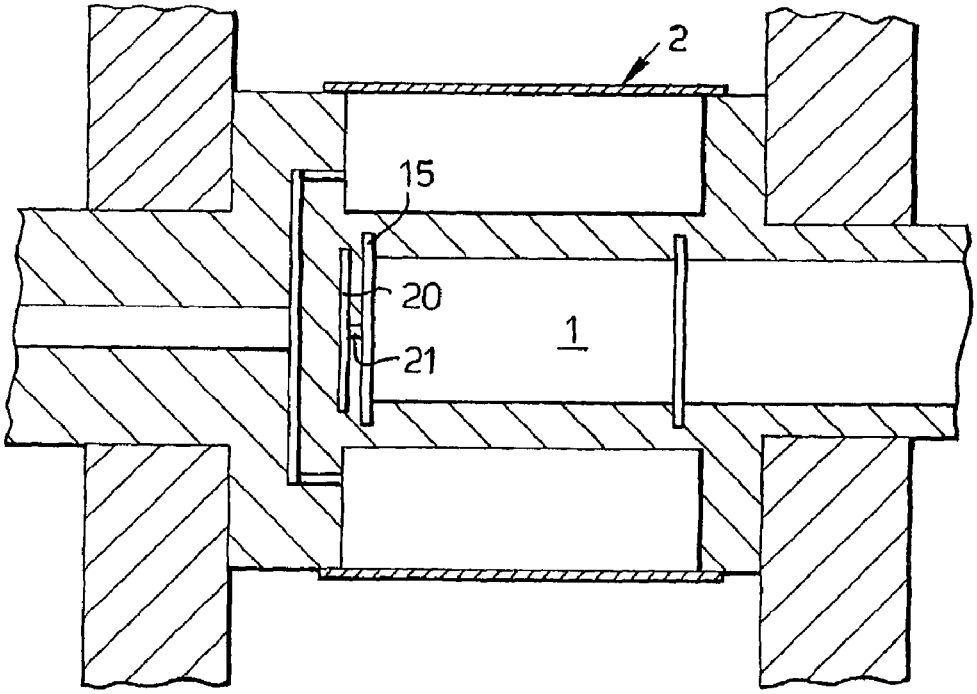
FIG. 4 schematically illustrates a longitudinal section another magnetron in accordance with the invention.

FIG. 4 illustrates another embodiment in accordance with the invention. The magnetron is similar to that illustrated in FIG. 2 but in this case, a decoupling plate 20 is supported by a post 21 which is mounted on the end hat 15 of the cathode 1. The equivalent circuit of this arrangement is the same as that illustrated in FIG. 3.

The invention claimed is:

1. A magnetron, comprising:

a) a cathode coaxially surrounded by an anode;

b) an axial output having an output coupling member connected to the anode; and c) a decoupling plate located between an end of the cathode and the member, the plate having dimensions and being located such that a resonant frequency of its equivalent circuit is substantially an operating frequency of the magnetron.

2. The magnetron as claimed in claim 1, wherein the decoupling plate is a planar disc.

3. The magnetron as claimed in claim 1, wherein the decoupling plate is supported by a post.

4. The magnetron as claimed in claim 3, wherein the post is mounted on the cathode.

5. The magnetron as claimed in claim 1, wherein the plate is constituted of copper.

6. The magnetron as claimed in claim 1, wherein the anode includes a plurality of anode vanes, and wherein the member includes a disc and electrical connections to connect the disc with alternate ones of the anode vanes.

7. The magnetron as claimed in claim 3, wherein the post is mounted on the member.

8. The magnetron as claimed in claim 1, the magnetron being operative at X band.

* * * * *